US006732447B2

(12) United States Patent
Tomasi et al.

(10) Patent No.: US 6,732,447 B2
(45) Date of Patent: May 11, 2004

(54) DRYING APPARATUS

(75) Inventors: Donald Mark Tomasi, Stevensville, MI (US); James I. Czech, Stevensville, MI (US); Michael R. MacKay, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 73 days.

(21) Appl. No.: 09/992,504

(22) Filed: Nov. 6, 2001

(65) Prior Publication Data

US 2003/0084585 A1 May 8, 2003

(51) Int. Cl.[7] ..... F26B 19/00

(52) U.S. Cl. ..... 34/90; 34/106; 34/600; 34/239

(58) Field of Search ..... 34/90, 104, 105, 34/106, 600, 239

(56) References Cited

U.S. PATENT DOCUMENTS

| | | | | | |
|---|---|---|---|---|---|
| 4,312,551 | A | * | 1/1982 | Mascolo et al. | 439/100 |
| 4,908,957 | A | | 3/1990 | Acosta, Sr. et al. | 34/86 |
| 5,276,979 | A | | 1/1994 | Gordon, Sr. | 34/133 |
| 5,287,636 | A | * | 2/1994 | Lafleur et al. | 34/104 |
| 5,398,428 | A | | 3/1995 | Wallace | 34/600 |
| 5,632,099 | A | * | 5/1997 | Seifert et al. | 34/106 |
| 5,743,025 | A | * | 4/1998 | Jordan, Jr. | 34/600 |
| 5,974,693 | A | | 11/1999 | Richards et al. | 34/600 |

* cited by examiner

*Primary Examiner*—Pamela Wilson
(74) *Attorney, Agent, or Firm*—John C. Colligan; Robert O. Rice; Stephen Krefman

(57) ABSTRACT

A shoe drying device having two arms and an airflow channel extending therethrough. A spring exerts an outward force on the arms. Each arm includes a member for holding a shoe at an end thereof. During a drying cycle, convection air enters through an air inlet towards the center of the device, flows through the airflow channel, and exits through air outlets in the members for holding a shoe at the ends of the arms. This facilitates more even drying of shoes held in the members for holding shoes.

16 Claims, 8 Drawing Sheets

DRYING APPARATUS

TECHNICAL FIELD

This invention relates to drying apparatus and, more particularly, to an apparatus for drying footwear in a drying device.

BACKGROUND

Various types of drying devices are known in the art. Domestic automatic clothes dryers, for example, are drying devices routinely used in households for drying wet or washed laundry, etc. Such automatic clothes dryers typically include a rotating drum operatively connected to a source of heat. During a typical drying process, heat is introduced into the drum while the drum rotates, and the heat is delivered to the contents of the drum, which usually occurs by a stream, or airflow, generated by an air moving device such as a fan or a blower. Thus, items placed in the drum, such as common household laundry, are dried by the heat and the air stream.

Often times, it is desirable to dry household items other than laundry in a drying device. Footwear, such as shoes, for example, may sometimes be washed in a washing machine or by hand, and it may be desirable to dry the washed footwear faster than just letting it sit and air-dry. Shoes loosely placed in the drum of a drying device, however, generate undesirable noise when they collide against the walls of the drum when the drum rotates. Shoes may also get damaged during such process. Devices that hold shoes in place relative to the walls of the drum to help eliminate such noise, however, do not dry the shoes as evenly and thoroughly as is typically desirable. This is usually because the heat, such as the heat in the air stream in the drum, is delivered mostly to the exterior of the shoes. A comparatively minor amount of the heat, if any, is delivered to the interior of the shoes such as the toe area inside the shoes.

To overcome such problems, shoes are usually removed from the drying device before their interior is fully dry. This is usually not desirable because the shoes are not completely dry when removed from the drying device, whereby they may not be dry enough to wear. In other instances, shoes are dried further until their interior is also dry, but this process wastes energy and can damage the shoes by continuing to apply heat to the already dry exterior of the shoes. Therefore, it is desirable to have footwear drying apparatus that facilitates more even drying of the exterior and the interior of footwear in a drying device.

Accordingly, the present invention is directed to overcoming one or more of the problems as set forth above.

SUMMARY OF THE INVENTION

In one aspect of the invention, a footwear drying apparatus is disclosed for use in a drying device. The footwear drying apparatus is preferably adjustable so that it may be accommodated in drums of most drying devices and, further, accommodate shoes of different sizes. A pair of shoes can be held relative to the footwear drying apparatus and the drum of the drying device during the drying process. The footwear drying apparatus facilitates convection air to flow through its body to the interior of the footwear, whereby the footwear is dried more evenly on its exterior and its interior.

DETAILED DESCRIPTION OF THE PREFERRED EMBODIMENTS

Figure 1:
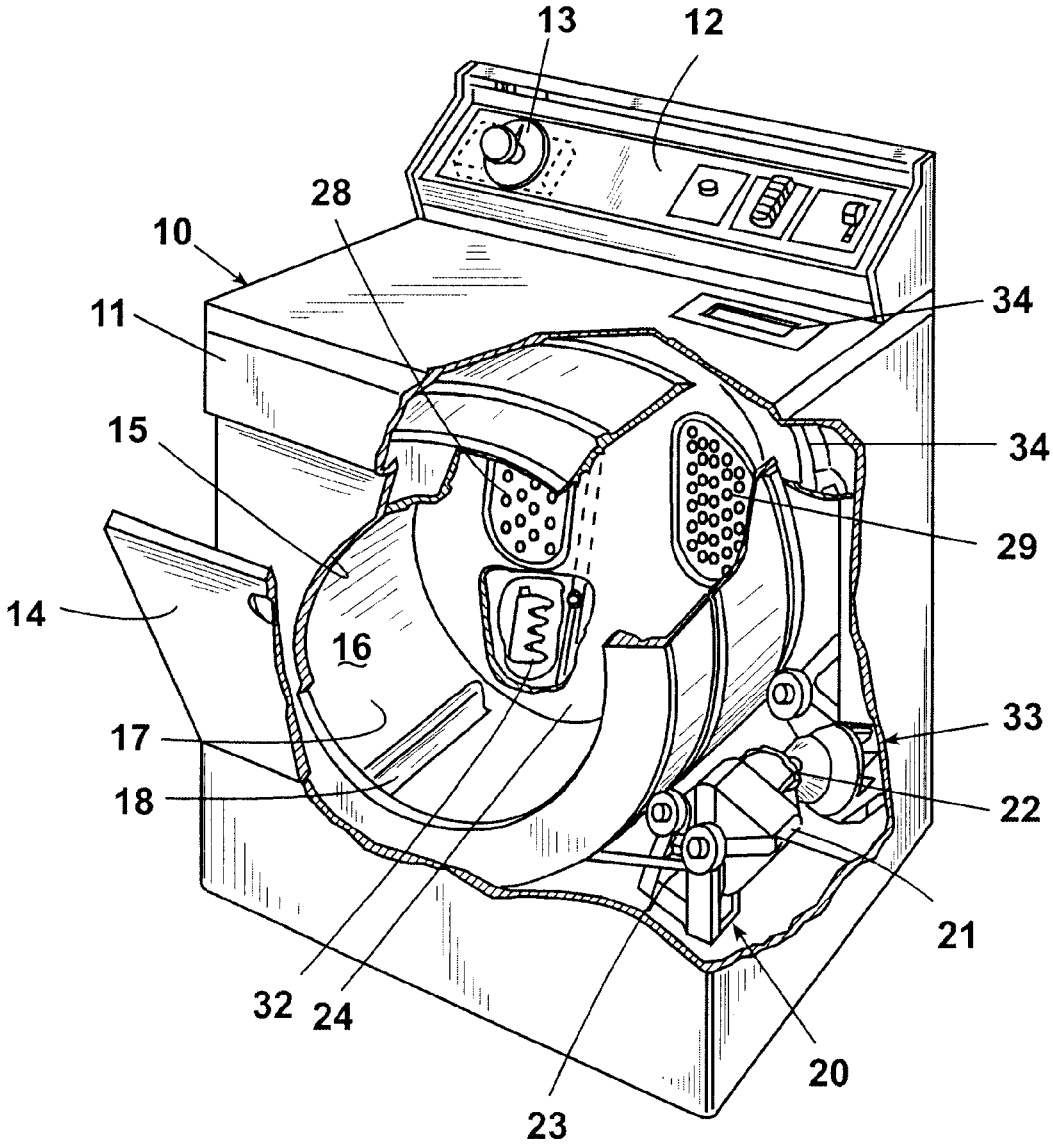
FIG. 1 is a partly broken away perspective view of a typical drying device.

Referring to the drawings, a domestic automatic clothes dryer is shown generally at 10 in FIG. 1. The dryer has a standard cabinet 11 having a control panel 12, including a control dial 13 for a presettable control means by which the dryer may be pre-set to automatically operate through a programmed sequence of a drying operation. A hinged door 14 opens on the front face of the cabinet 11. Behind the door 14 is a receptacle opening 15 through which clothes or other items to be dried may be deposited in a treatment zone 16, characterized in this form of the invention by a drum 17 in the form of an imperforate cylindrical sidewall having radially inwardly extending vanes 18. Suitable drive means 20, including an electric motor 21, drive shaft 22, and pulley means 23 connected to the drive shaft 22 at the front side of the motor 21, rotate the drum 17. It should be understood that any drum construction or drive arrangement could be used herein in the treatment zone 16 in which materials are to be dried, so long as a stream of temperature conditioned air is directed through the zone 16 to enhance the drying operation.

Figure 2:
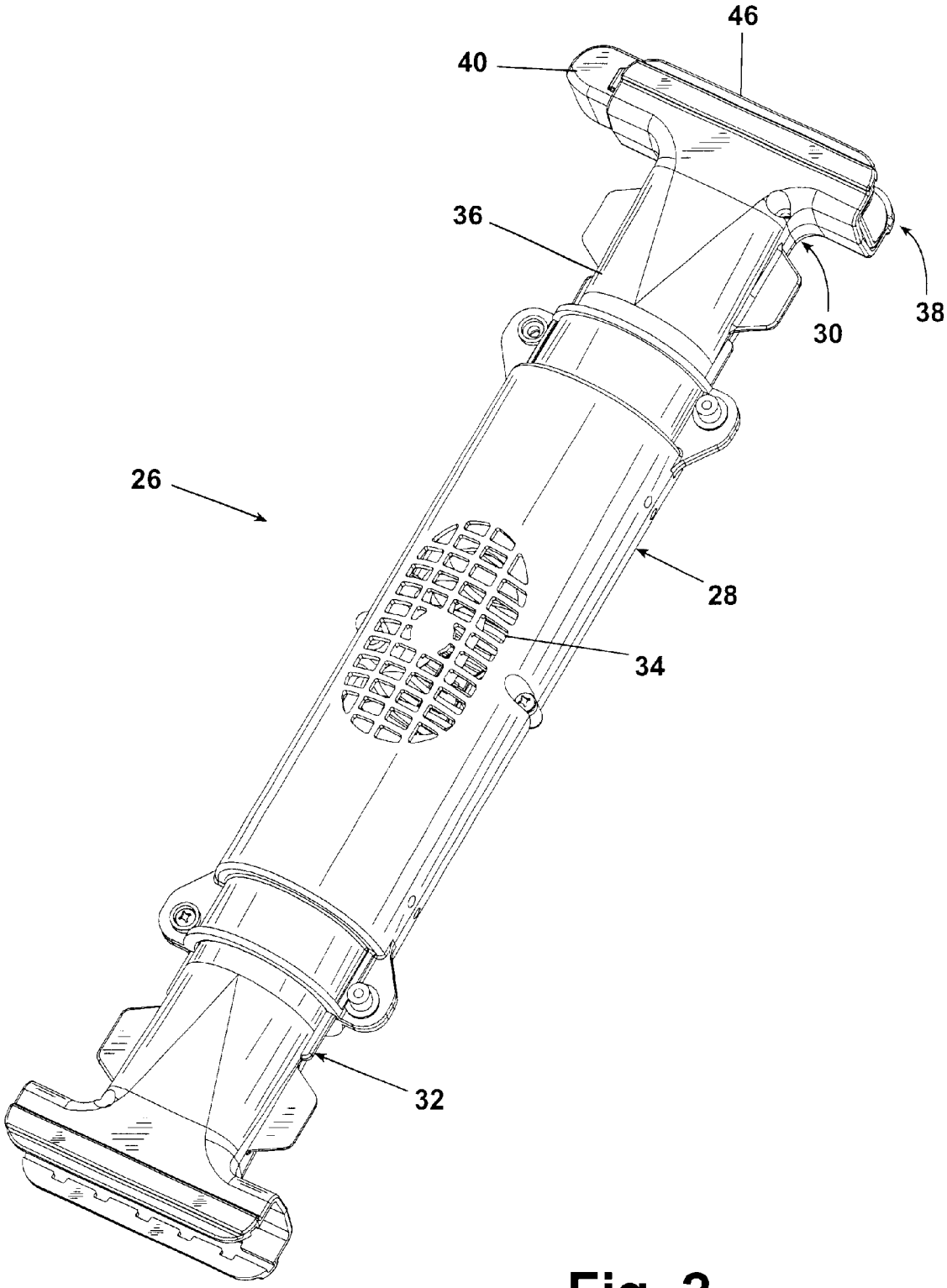
FIG. 2 is a perspective view of a footwear drying apparatus according to one embodiment of the present invention.

Referring to FIG. 2, a perspective view of a footwear drying apparatus 26 according to one embodiment of the present invention is shown. The footwear drying apparatus, or shoe drying device, 26 includes an elongated member formed by three main components, a center body 28, a first arm 30 and a second arm 32. The center body 28 is a substantially hollow tubular-shaped piece, and includes an air inlet 34. In one embodiment, the air inlet 34 includes a means for substantially preventing undesirable items, such as clothing, from entering the interior of the device 26. In one embodiment, such means is a grill structure with openings of a predetermined shape or design. In other embodiments, however, the such means may be just a simple opening of a small size, a wire mesh, or any other type of opening capable of permitting airflow therethrough known in the art. In one embodiment, there are two oppositely disposed air inlets 34, although it is recognized and anticipated that other embodiments may have more or fewer air inlets 34.

The arms 30 and 32 are operatively connected to the center body 28 at opposite ends thereof. In one embodiment, the arms 30 and 32 are substantially identical, although it is recognized and anticipated that they might differ in alternate embodiments of the present invention. In the embodiment shown in FIG. 2, the arms 30 and 32 are hollow with a cylindrical portion 36 and a head portion 38. The cylindrical portion 36 is preferably slidably connected to the center body 28, whereby the respective arm 30 or 32 can slide inside the hollow interior of the center body 28. Each arm 30 and 32 preferably includes a mechanism, such as a flange abutting against an edge, wall or another flange at each end of the center body 28, that prevents it from sliding completely out of the center body 28.

It will be appreciated that the hollow interior of the center body is in air communication with the hollow interior of the arms 30 and 32. In this regard, it is preferable that the seam between the hollow interior of the arms 30 and 32 and the hollow interior of the center body 28 be substantially airtight with respect to the exterior of the shoe drying device 26. However, air leakage between the seams and the exterior of the device 26, if any, is possible, although such leakage may impede the performance of the device 26.

The head portion 38 on each arm 30 and 32 is also hollow, and includes a slider 40 slidably disposed in a slide 42. In one embodiment, the slider 40 has one or more rails that cooperatively engage with one or more corresponding grooves in the slide 42. The cooperative engagement between the rails in the slider 40 and the grooves in the slide 42 permits the slider 40 to slide with respect to the slide 42. The slide 42 and slider 40 preferably also include a mechanism, such as another extension 41 (better shown in FIG. 5) in the slide 42 that acts as a stop, to prevent the slider 40 from completely sliding out of the slide 42. Further, one embodiment of the slider 40 includes position detenting relative to the slide 42 to help maintain the slider's 40 position with respect to the slide 42 when a shoe is placed thereon.

Figure 4:
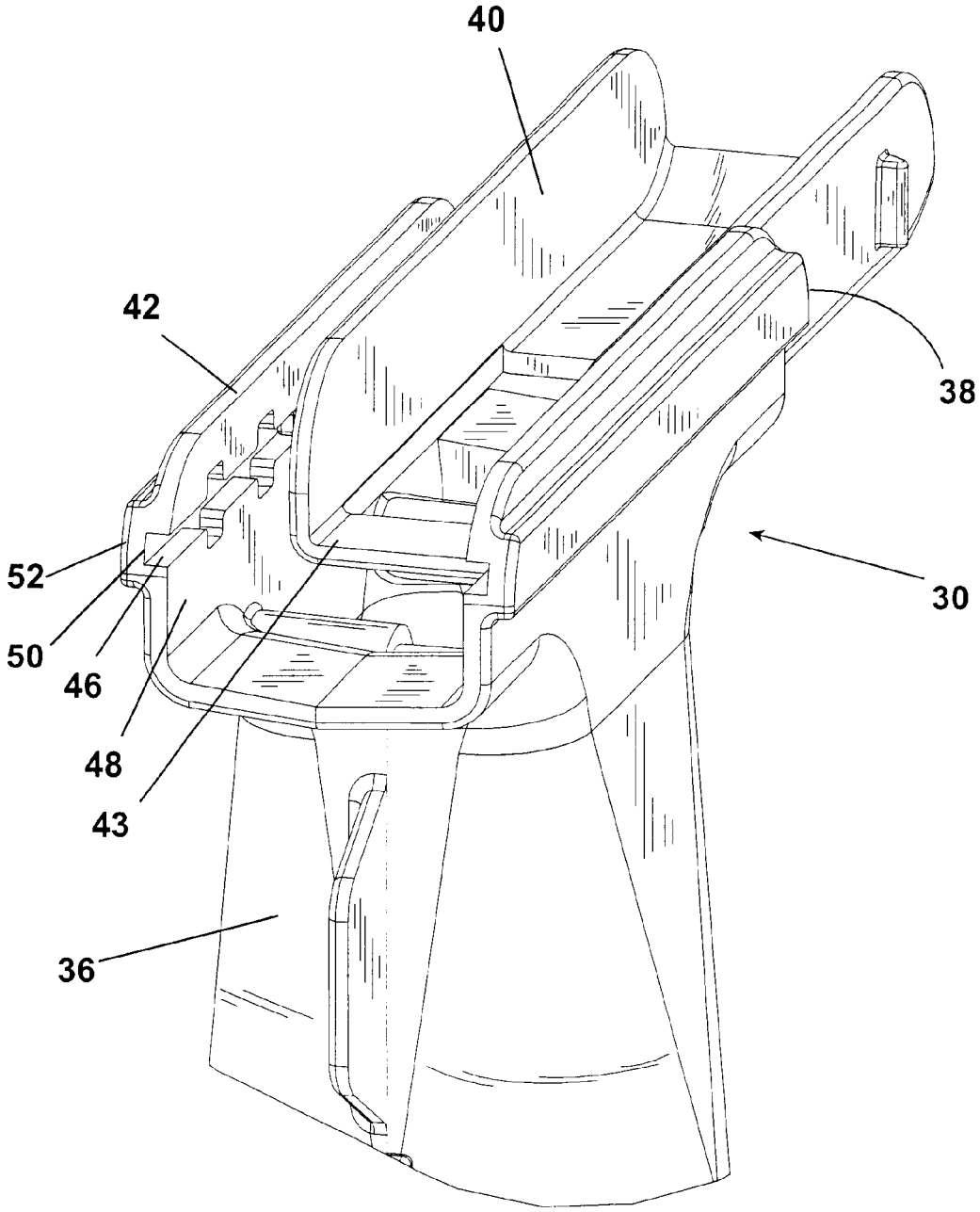
FIG. 4 is an elevated perspective view of one end of the footwear drying apparatus of FIG. 2 having a mechanism to hold a shoe.

The head portion 38 on each arm also includes an air outlet 43 (better shown in FIG. 4). The air outlet 43 is in air communication with the hollow interior of the arms 30 and 32. Those skilled in the art will appreciate that the shoe drying device 26 thus defines an airflow channel from the air inlet 34, through the hollow elongated body of the device 26, to the air outlet 43 in the head portion 38.

The slider 40 serves to lengthen the airflow channel by extending the air outlet 43 further into the interior of the shoe, particularly towards the toe area of the shoe. Those skilled in the art will appreciate that this feature enhances drying of the difficult to dry areas in the interior of a shoe, such as the toe areas, because air exiting from the air outlet 43 must travel from the toe area through the entire interior of the shoe. This facilitates more even drying of the interior of the shoe.

Figure 3:
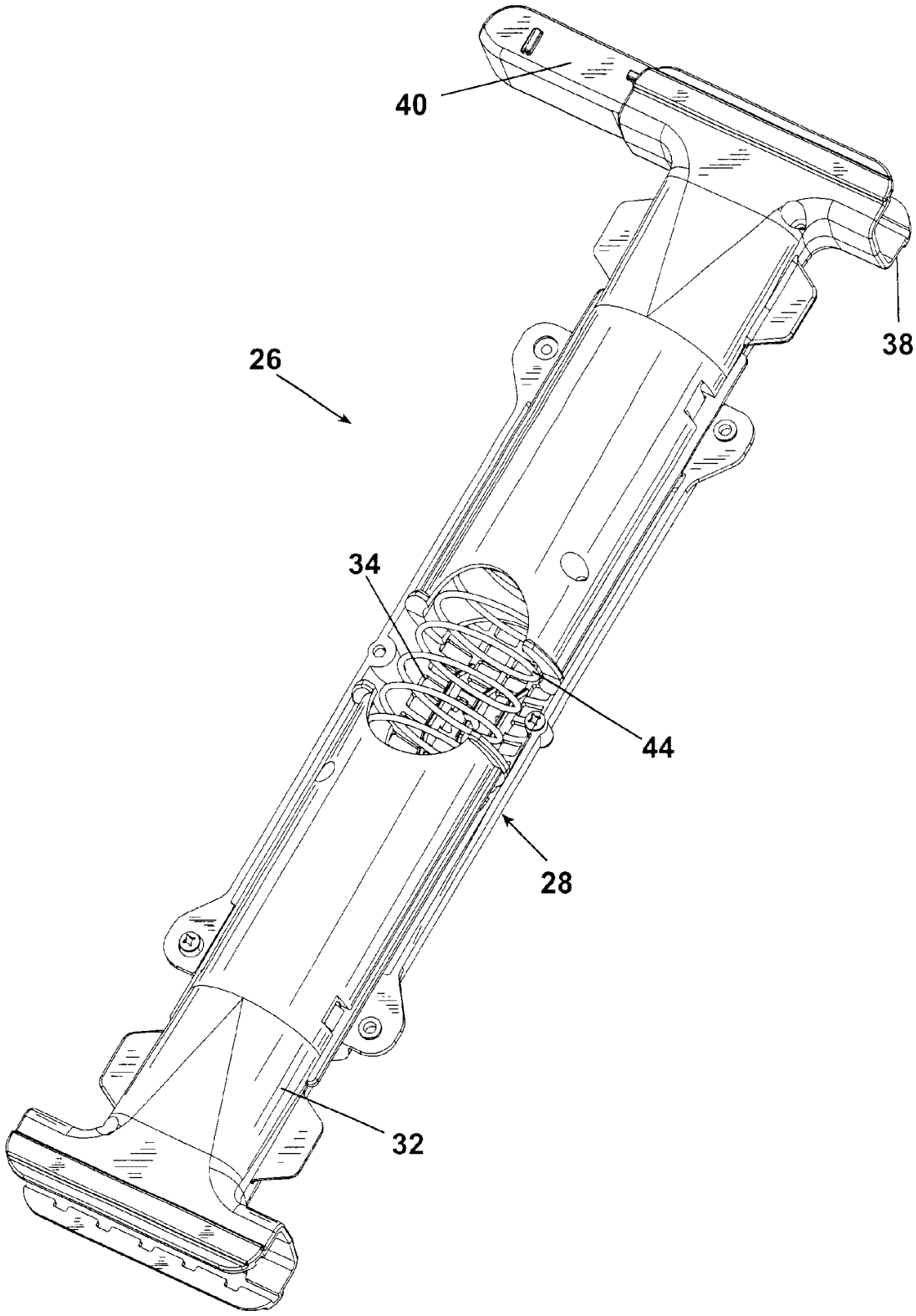
FIG. 3 is a partially broken away perspective view of a portion of the footwear drying apparatus of FIG. 2.

Referring to FIG. 3, a partially broken away perspective view of a portion of the shoe drying device 26 is shown. Disposed in the hollow interior of the center body 28 is a spring 44. The spring 44 exerts an outward force against each of the arms 30 and 32. As a result, the arms 30 and 32 can be slidably pushed into the center body 28 against the force of the spring 44. Further, as discussed above, there is preferably a mechanism, such as a flange, in the drying device 26 that prevents the arms 30 and 32 from sliding completely out of the center body 28 due to the force of the spring 44. In one embodiment, the spring 44 is radially centered in the center body 28, such as by tabs, to help keep the air opening centrally located. This helps facilitate more uniform drying of two shoes held in the shoe drying device 26.

Referring to FIG. 4, an elevated perspective view of one end of the shoe drying device of FIG. 2 having a mechanism to engage a shoe is shown. The arm 30 includes the head portion 38 at the end of the cylindrical portion 36. The head portion 38 includes the slider 40 operatively positioned in the slide 42. The slider includes externally protruding rails 46 on at least one side-wall 48. In the preferred embodiment, each side-wall 48 has the rails 46 for smoother operation and better guidance of the slider 40 with respect to the slide 42. The slide 42 includes a groove 50 in its side-wall 52 corresponding to the rails 46. In embodiments wherein both side-walls 48 of the slider 40 have rails 46, it is anticipated that both side-walls 52 of the slide 42 will have corresponding grooves 50. In this configuration, those skilled in the art will appreciate that the slider 40 can be slid in the slide 42 to extend the head 38. In such extended configuration, the head 38 can be utilized in holding a shoe with respect to the shoe drying device 26. The rails 46 may be a continuous raised strip as illustrated, or may comprise a series of spaced projections arranged linearly to be received in the groove 50. Further, the orientation and placement of the rails 46 and grooves 50 may be reversed, that is, the rails may be provided on the slide 42 and the grooves 50 on the slider 40 if desired.

Figure 5:
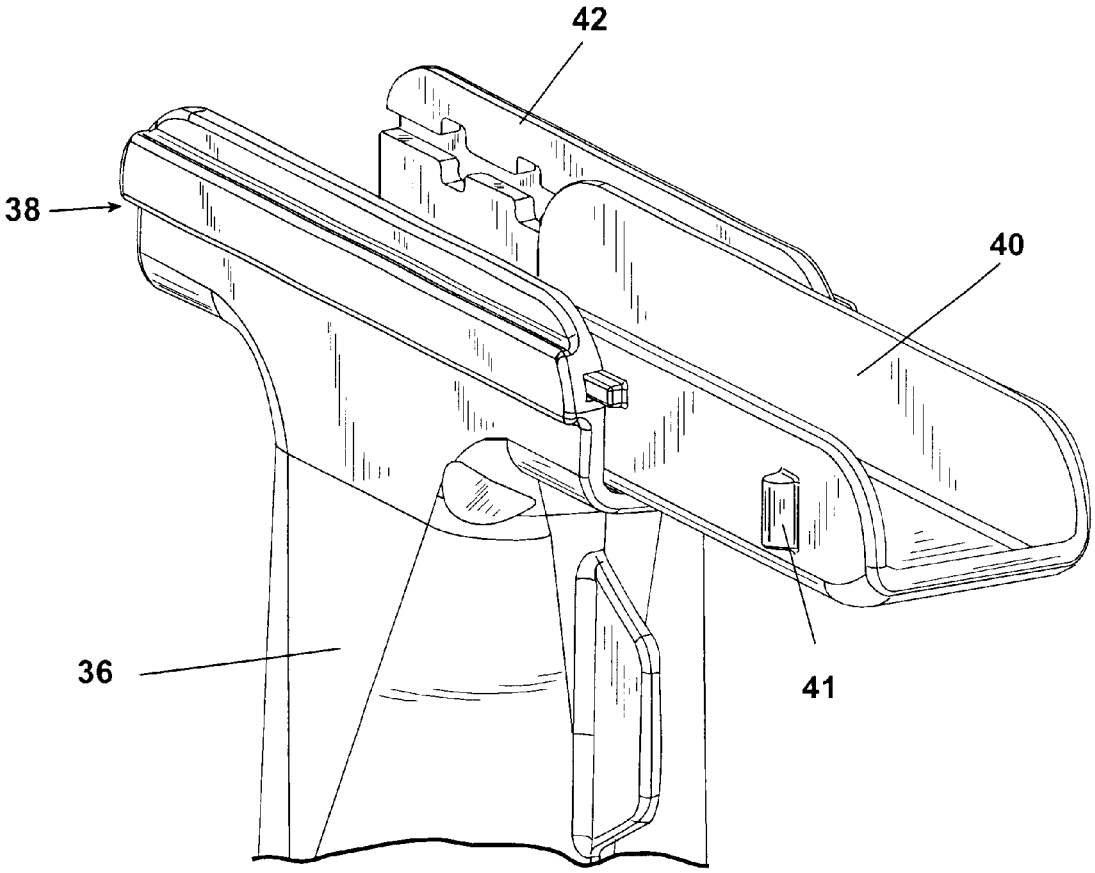
FIG. 5 is an elevated perspective view of the end of the footwear drying apparatus shown in FIG. 4 with the mechanism to hold a shoe operatively extended.

Referring to FIG. 5, an elevated perspective view of the head portion of the shoe drying device 26 is shown with the mechanism to hold a shoe operatively extended to hold a piece of footwear. As shown, the slider 40 is slid relative to the slide 42, whereby the head portion 38 has an elongated length. Those skilled in the art will appreciate that a shoe can be relatively easily placed upon the head end 38 when it is in its non-extended position as shown in FIG. 4, and the slider 40 can subsequently be extended to its extended position as shown in FIG. 5, up to the length of the shoe or less, whereby the shoe will be held relative to the head portion 38 and the shoe drying device 26. The shoe can be removed by reversing the steps above, i.e. by un-extending the head portion 38 and removing the shoe.

Figure 6:
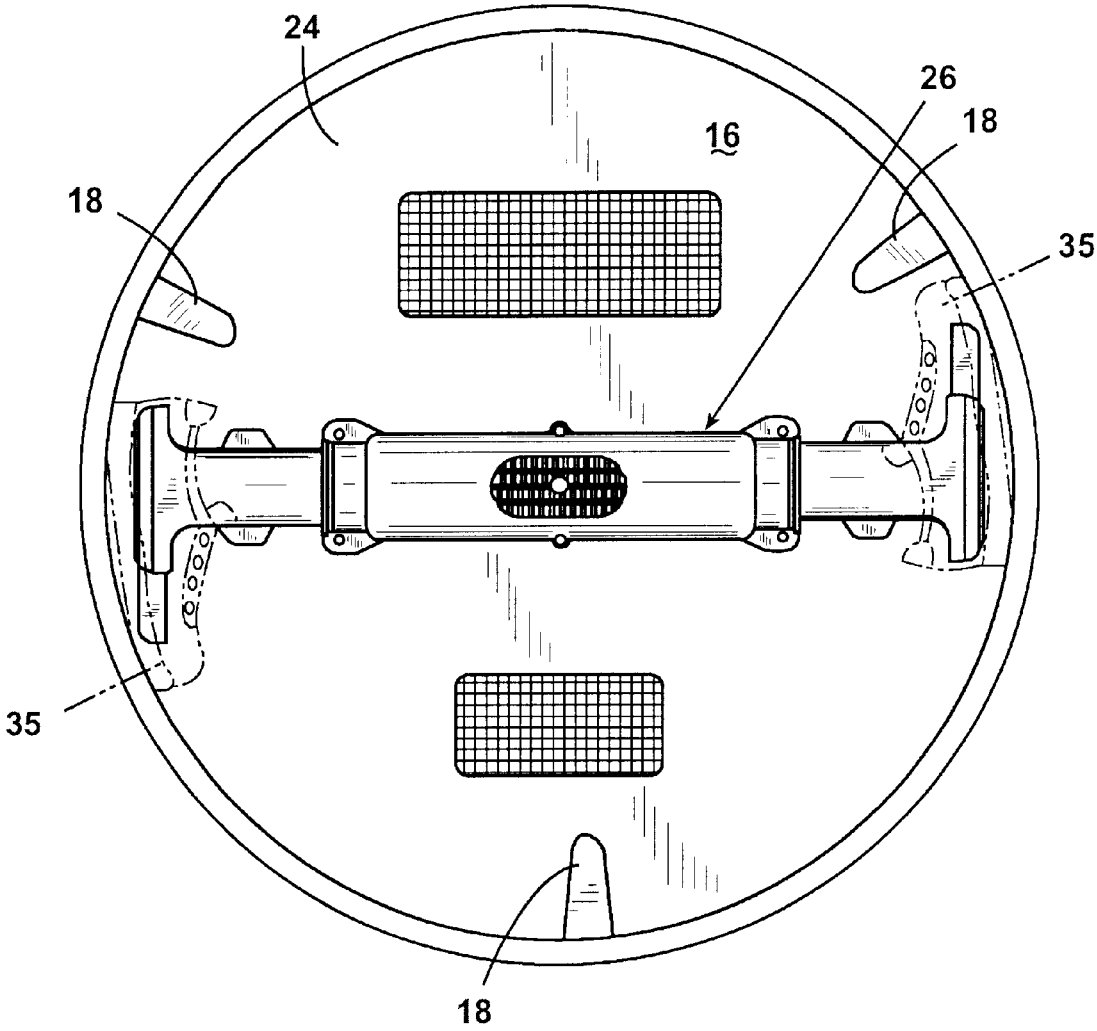
FIG. 6 is a front view of the footwear drying apparatus of FIG. 2 operatively positioned in a drum of a drying device, with a phantom view of shoes engaged in the ends of the footwear drying apparatus.

Those skilled in the art will appreciate that a pair of shoes can be held in this manner by the shoe drying device 26, one each on the head portion 38 of each arm 30 and 32. With the two shoes thus in place, the arms 30 and 32 can be pushed in against the force of the spring 44 and the shoe drying device 26 can be placed in the drum of a drying device. When the arms 30 and 32 are released in the drum of a drying device, the outward force exerted by the spring 44 upon the arms 30 and 32 causes the arms 30 and 32 to engage the walls of the drum with the pair of shoes at the outer ends of the arms 30 and 32 being pushed against the walls of the drum. Referring to FIG. 6, a front view of the shoe drying device 26 operatively positioned in a drum of a drying device, with a phantom view of shoes 35 engaged in the ends of the footwear drying apparatus is shown. In this position, the shoe drying device 26 will be held in place frictionally relative to the walls of the drum due to the outward force of the spring 44. Thus placed in the drum of a drying device, the shoes are held in place despite the rotation of the drum during a drying cycle and the movement of other items which may be in the drum while the drum rotates.

With the shoe drying device held in place by the force of the spring 44, the air outlets 43 will be positioned adjacent to the drum wall, while the opening 34 is positioned near the center of the drum. When the drum is rotated, such as during a drying cycle, the drying device spins with the drum and the air outlets 43 move through a circular path having a diameter nearly that of the drum. Centrifugal force acts on air molecules in the shoe drying device near the air outlets 43. As the drum rotates, centrifugal force tends to accelerate air outwardly, thereby causing an airflow through the shoe drying device, into the opening 34, out through the arms 30 and 32, and out through the air outlets 43 into the shoes.

It will be appreciated that the shoe drying device 26 can be accommodated in a range of drum-sizes of different drying devices. Because the arms 30 and 32 can be pushed in against the force of the spring 44, the arms 30 and 32 can be pushed in more to fit into smaller sized drums, and vice versa.

During a drying cycle, the present apparatus facilitates more even drying of the footwear as the drum rotates. The shoe drying device 26 rotates with the drum as the drum rotates during a drying cycle. The rotation of the shoe drying device 26 creates airflow through it because of the airflow channel formed by the hollow center body 28 and the hollow arms 30 and 32. Air, therefore, flows through air inlet 34 into the shoe drying device 26, through the airflow channel formed by the hollow center body 28 and the hollow arms 30 and 32, and exits through the corresponding air outlets in the head portion 38. This air is thus delivered to the interior of the shoes held by the shoe drying device 26, thereby facilitating drying of the toe areas and the interior of the shoes. Those skilled in the art will appreciate that this facilitates more even drying of the shoes during a drying cycle, including the exterior as well as the interior of the shoes.

In one embodiment, the shoe drying device 26 is constructed of polypropylene with about 25% glass, with the exception of the spring, which is made of a metallic material known in the art. It is important that the material of the device 26 be able to withstand the high temperatures that are typically achieved in drying devices. In this regard, it is recognized and anticipated that the device 26 may be made of a different material without departing from the spirit and scope of the present invention.

Figure 7:
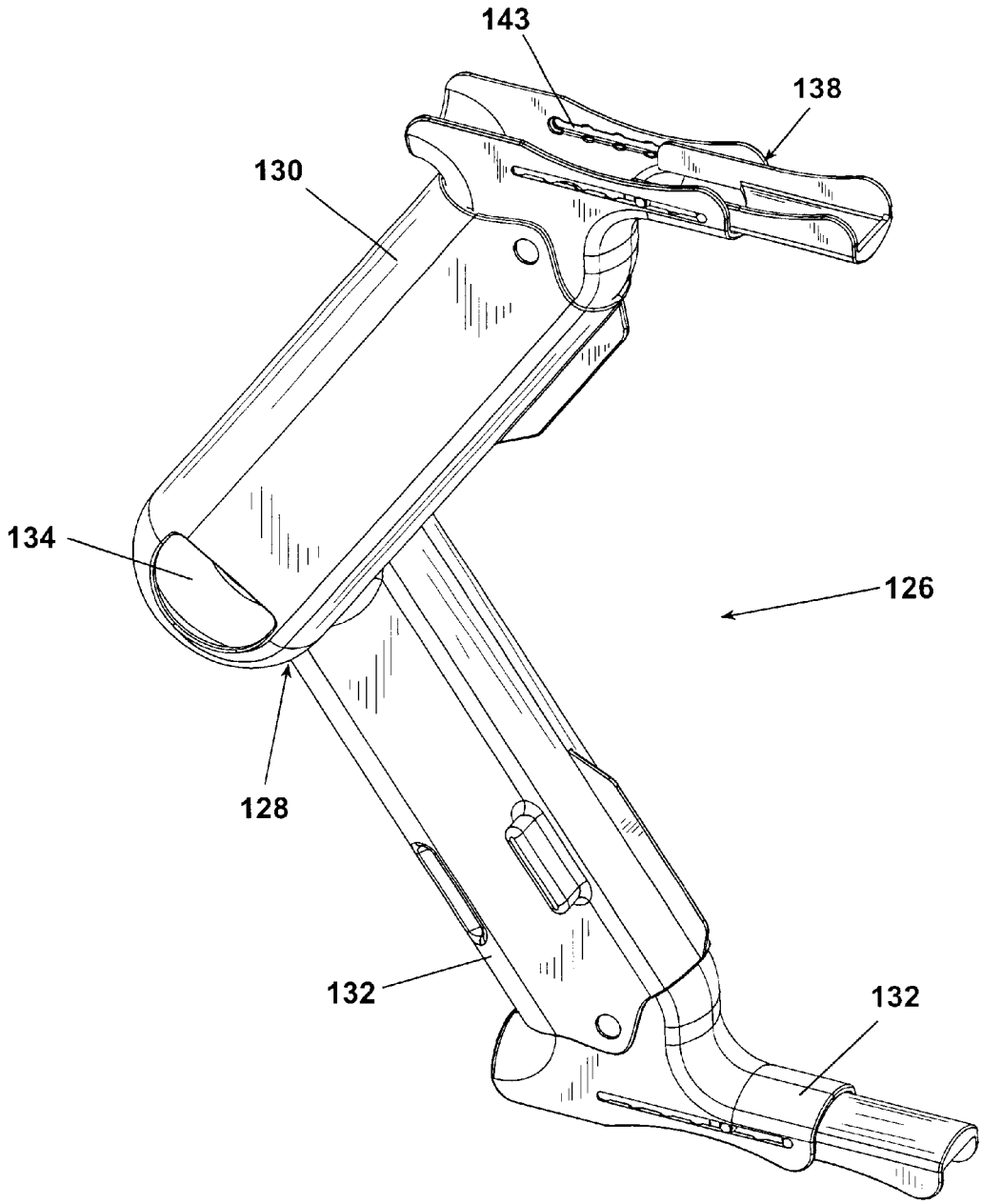
FIG. 7 is an elevated perspective view of an alternate embodiment of a footwear drying apparatus of the present invention.

Referring to FIG. 7, an elevated perspective view of an alternate embodiment of a footwear drying apparatus of the present invention is shown. In this embodiment, the arms 130 and 132 of the shoe drying device 126 fold at a pivot point 133 in the center body 128. In this embodiment, a spring (not shown) in the center body 128 biases the shoe drying device 126 in its fully extended position, and the arms 130 and 132 cannot be pushed in. But the arms 130 and 132 of the shoe drying device 126 can be folded for easier positioning in a drum of a drying device, and the force of the spring extends the shoe drying device 126 to its fully extended position, whereby the head portions 138 contact the walls of the drum. In this manner, shoes held in the head portions 138 are held against the walls of the drum by the force of the spring during a drying cycle when the drum rotates. Air is delivered to the interior of the shoes while the drum rotates through the air inlet 134 in the center body 128, the air channels formed by the hollow bodies of the shoe drying device 126, and through air outlets 143 in the head portions 138.

Figure 8:
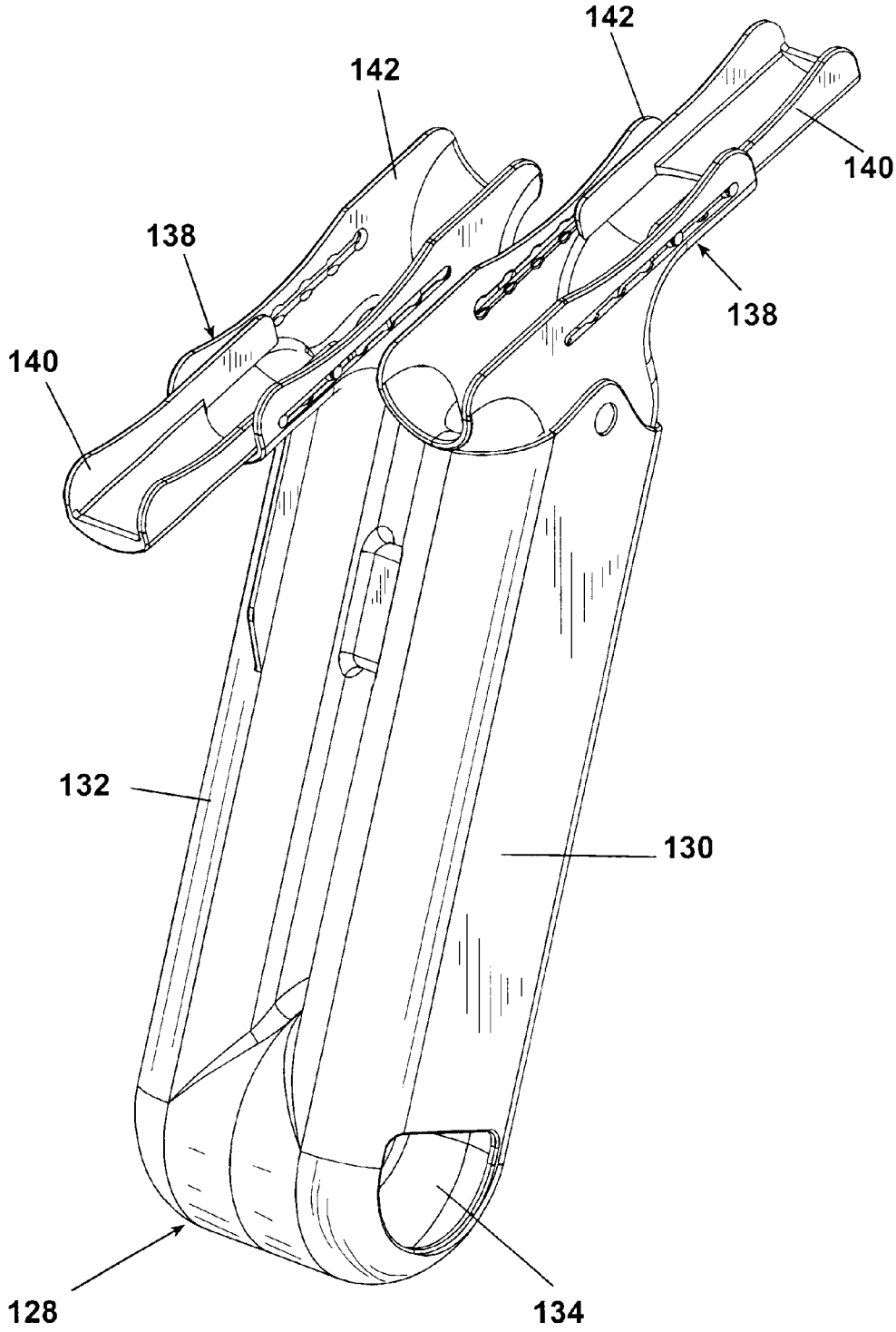
FIG. 8 is an elevated perspective view of the footwear drying apparatus of FIG. 7 with the apparatus collapsed or folded at a pivot point.

Referring to FIG. 8, an elevated perspective view of the footwear drying device 126 of FIG. 7 with the apparatus collapsed or folded at a pivot point in the center body 128 is shown. As shown, the arms 130 and 132 cooperatively collapse together whereby the device 126 can be conveniently stored. Further, sliders 140 are shown extended in their respective slides 142 to illustrate the operability of the apparatus of the head portions 138. In one embodiment, the head portions 138 are substantially similar to the apparatus of the head portions 38 described above. It is recognized and anticipated, however, that such apparatus may vary in alternate embodiments without departing from the spirit and scope of the present invention. Those skilled in the art will appreciate that the device 126 of this embodiment, in its extended position, will also serve substantially identically as discussed for the embodiment of FIGS. 2–5 for drying shoes in a drying device.

As is evident from the foregoing description, certain aspects of the present invention are not limited to the particular details of the examples illustrated herein, and it is therefore contemplated that other modifications and applications will occur to those skilled in the art. For example, alternate embodiments of the present invention may have a different mechanism to hold shoes instead of the slide and slider combination discussed above. An alternate embodiment may have a stud or mount to simply slide a shoe thereon, or the like. Other embodiments may have more than just two arms to accommodate more than one pair of shoes for a drying cycle. For example, an alternate embodiment may have four arms, each pair of arms pushed outwards by a respective spring, to accommodate two pairs of shoes. Other alternate embodiments of the present invention may have one or more different extension mechanism, such as threaded, hole-and-pin, telescoping, deformation, or a combination thereof. Multiple pieces could replace single pieces while providing essentially the same desired result, and vice-versa. It is, accordingly, intended that the claims shall cover all such modifications and applications that do not depart from such spirit and scope of the present invention.

Other aspects, objects and advantages of the present invention can be obtained from a study of the drawings, the disclosure and the appended claims.

The embodiments of the invention in which an exclusive property or privilege is claimed are defined as follows:

1. A footwear drying apparatus and a means for affixing the drying apparatus in a drum of a drying device, the footwear drying apparatus comprising:

a tubular elongate member with a center body and at least one end, the elongate member having an airflow channel extending along a length thereof;

an air inlet in the center body of the elongate member;

an air outlet in the at least one end of the elongate member, wherein the airflow channel in the elongate member is in air communication with the air inlet and the air outlet and the airflow channel guides airflow from the air inlet to the air outlet therethrough when the drum rotates.

2. The footwear drying apparatus of claim 1, wherein the at least one end of the elongate member includes a member for engaging a shoe.

3. The footwear drying apparatus of claim 2, wherein the member for engaging a shoe includes an extendable element disposed in a slide, the extendable element being slidable with respect to the slide.

4. The footwear drying apparatus of claim 1, wherein the elongate member has two ends, and each end includes a member for engaging a shoe.

5. The footwear drying apparatus of claim 4, wherein the member for engaging a shoe on each end includes an extendable element disposed in a slide, the extendable element being slidable with respect to the slide.

6. The footwear drying apparatus of claim 4, wherein the two ends of the elongate member are extendable and retractable with respect to a longitudinal axis of the center body.

7. The footwear drying apparatus of claim 6, further comprising a spring in the center body, the spring exerting an outward force on the two ends, wherein the two ends can be pushed in relative to center body against the force of the spring.

8. The footwear drying apparatus of claim 1, further comprising at least two air inlets in the center body, each the air inlet including a means for substantially preventing undesirable items from entering an interior of the footwear drying apparatus.

9. The footwear drying apparatus of claim 1, wherein the apparatus is constructed of polypropylene with about 25% glass.

10. A footwear drying apparatus for use in a clothes dryer having a rotating drum, a heat source for heating air operatively connected to the drum, and an air moving device for circulating air within said drum, comprising:

a generally tubular, hollow, center body having a pair of open ends and a plurality of laterally opposed side air inlets;

a pair of footwear engaging arms extending in opposite directions from the open ends in the center body, wherein air flows from the air inlet to air outlets in the footwear holding arms through the hollow center body when the drum rotates.

11. The footwear drying apparatus of claim 10, wherein the footwear holding arms include members for engaging a shoe in each respective footwear holding arm.

12. The footwear drying apparatus of claim 11, wherein the members for engaging a shoe include a slider disposed in a slide, the slider being slidable with respect to the slide.

13. A footwear drying apparatus for use in a clothes dryer having a rotating drum, a heat source for heating air operatively connected to said drum, and an air moving device for circulating air within said drum, comprising:

a generally tubular, hollow, center body having a pair of open ends and a plurality of laterally opposed side air inlets;

a pair of footwear engaging arms extending in opposite directions from the open ends in said center body and being slidable with respect to the center body; and a spring in the center body, the spring exerting an outward force on the pair of footwear holding arms, wherein the pair of footwear holding arms can be pushed in relative to the center body against the force of the spring.

14. A footwear drying apparatus for use in a drying device, comprising:

an elongate member with an airflow channel extending along a length thereof, the elongate member having two ends foldably connected to each other;

a spring disposed in the elongate member, the spring exerting a force on the two ends of the elongate member such that the elongate member is biased to a fully extended position, an air inlet towards a center of the elongate member;

an air outlet in each of the two ends of the elongate member; wherein the airflow channel in the elongate member is in air communication with the air inlet and the air outlets.

15. A footwear drying apparatus for use in a drying device, comprising:

an elongate member with an airflow channel extending along a length thereof, the elongate member having two ends foldably connected to each other;

an air inlet towards a center of the elongate member;

an air outlet in each of the two ends of said elongate member, wherein the airflow channel in the elongate member is in air communication with the air inlet and the air outlets and wherein convection air flows from the air inlet to the air outlets through the airflow channel when the drum rotates.

16. The footwear drying apparatus of claim 15, wherein the two ends of the elongate member each include a member for engaging a shoe, each of the member for engaging a shoe including an extendable element disposed in a slide, the extendable element being slidable with respect to the slide.

* * * * *